United States Patent [19]

Burkey et al.

[11] 4,169,017

[45] Sep. 25, 1979

[54] METHOD OF MAKING AN ELECTROFORMING MANDREL

[75] Inventors: David J. Burkey, Millersville; Lawrence Clark, Lancaster; Jay R. George, Manheim; Harry F. Long, Lancaster, all of Pa.

[73] Assignee: Armstrong Cork Company, Lancaster, Pa.

[21] Appl. No.: 890,456

[22] Filed: Mar. 27, 1978

[51] Int. Cl.[2] ..... C25D 1/10; C25D 1/20

[52] U.S. Cl. ..... 204/4; 204/6

[58] Field of Search ..... 204/3, 4, 9, 6, 20

[56] References Cited

U.S. PATENT DOCUMENTS

| | | | |
|---|---|---|---|
| 3,464,898 | 9/1969 | Norris | 204/9 |
| 3,535,211 | 10/1970 | Frowde | 204/6 |
| 3,649,474 | 3/1972 | Blakeslee et al. | 204/6 |

OTHER PUBLICATIONS

Product Engineering, Jun. 5, 1961, pp. 44–49.

*Primary Examiner*—T. M. Tufariello

[57] ABSTRACT

The invention is directed to an electroforming mandrel of a specific structure which is used for making an electroformed product. The invention also embodies a method for producing an embossing surface.

2 Claims, No Drawings

METHOD OF MAKING AN ELECTROFORMING MANDREL

BACKGROUND OF THE INVENTION

1. Field of the Invention

The invention concerns an improved method for the production of metal embossing surfaces by the electrolytic deposition of metal on the surface of an electrode having a certain construction.

2. Description of the Prior Art

U.S. Pat. No. 3,535,211 is directed to a process for producing a pattern embossing surface by electroplating an electrode.

U.S. Pat. Nos. 3,627,836 and 3,776,875 are directed to specific materials which are sold as molding and encapsulating compounds.

SUMMARY OF THE INVENTION

The invention, in part, incorporates a method of forming a metal embossing surface by an electrolytic deposition of metal on the surface of an electrode or mandrel. The electrode is made of a specific material which is part of the invention herein. The material being used for the electrode is a copolymer of styrene and butyl acrylate which has been polymerized in situ in a support phase of silicone liquid polymer. This material is formed into an electrode, and the electrode is then silver-plated. The silver-plated electrode is then utilized in an electroplating process to form a nickel embossing plate.

The invention herein is, in part, the recognition of the ability to use a specific material as an electrode when similar type materials in the past have proven to be insufficient for use as an electrode. The invention also contemplates a specific method of carrying out the electrolytic deposition process.

DESCRIPTION OF THE PREFERRED EMBODIMENT

The process invention herein is basically an improvement over the process of U.S. Pat. No. 3,535,211. A master is secured for the purposes of providing the pattern which is to be duplicated in a mirror image in the electrode for the electroplating process. In the above mentioned patent, a polymeric sheet is pressed against the master and formed into the required shape of the master. Herein, the specific polymeric material is in a liquid phase and is thus cast against the master. The polymeric material is manufactured by Stauffer-Wacker Silicone Corporation of Adrian, Michigan, and is sold under the trade name "Silgan." It is a unique composition wherein an organic component, which is a copolymer of styrene and butyl acrylate, is polymerized in situ in a support phase of silicone liquid polymer. U.S. Pat. Nos. 3,627,836 and 3,776,875 have been indicated by the manufacturer of the material in question to cover the silicone liquid polymer and the organic component silicone liquid polymer combination sold under the trade name "Silgan." The particular polymeric material is provided as a two-part system which is mixed together in a liquid phase and poured upon the master. It is permitted to cure at room temperature overnight. This then provides the required shape which will function as the electrode for an electroplating operation after application of a silver spray.

In U.S. Pat. No. 3,535,211 it is taught that the conductivity of the organic polymeric material is secured through the use of conductive fillers such as carbon black or metal powders in the polymeric material. In the invention herein, this technique is not utilized. After the electroplating electrode has been formed from "Silgan", it is silvered in a conventional manner. It is sprayed with a silver solution which is formed from a conventional concentrated silver solution sold by Peacock Laboratories, Inc. under the trade name "S-52." This is used with deionized water and an appropriate spray reducer to secure the proper viscosity and concentration of silver in the solution. The "Silgan" casting is sprayed with the silver solution. Approximately six passes of silver spray are utilized to provide a silver coating of about 0.004 mils in thickness. The silver coated casting is immediately placed in an electroplating bath, and the electroplating is carried out in a conventional manner as set forth in U.S. Pat. No. 3,535,211. A nickel coating ranging in thickness normally from 5 mils to 250 mils is then deposited upon the casting.

It has been found that, with most conventional silicone materials used as a mandrel or electrode, the release properties are so good that the weight from a small amount of electroformed nickel causes the silver surface to separate from the silicone mandrel and prevents the proper disposition of additional nickel on the embossing plate being formed. The use of a liquid polyurethane elastomer system to produce a mandrel overcomes the problem of premature separation of the silver surface from the mandrel, but in this case the bond between the two is so good that the removal of the nickel embossing plate from the polyurethane is very difficult, resulting in distortion of the electroformed plate and/or distortion of the polyurethane mandrel. The "Silgan" mandrel provides sufficient adhesion of the silver so that it remains in contact with the mandrel throughout the electroforming process, and when the desired thickness is obtained, the nickel embossing plate can be easily removed from the mandrel without distortion or damage to either. This permits multiple use of the "Silgan" mandrel.

What is claimed is:

1. In a method for producing a patterned surface by electroplating an electrode surface which is the negative of the electroplating bath, the improvement comprising:
   (a) forming the electrode from a nonconductive copolymer of styrene and butyl acrylate, polymerized in situ in a support phase of silicone liquid polymer,
   (b) covering the surface of the electrode to be subsequently metal plated with a conductive metal coating of about 0.004 mils, and
   (c) subsequently electrodepositing metal on the surface of the electrode covered with the metal coating and providing a second metallic coating ranging in thickness normally from 5 mils to 250 mils without any separation between the metal surface being formed and said electrode surface.

2. The method of claim 1 wherein the metallic coating for the electrode is a spray-applied silver coating.

* * * * *